US009763508B2

(12) United States Patent
Reishus et al.

(10) Patent No.: US 9,763,508 B2
(45) Date of Patent: Sep. 19, 2017

(54) APPLICATOR TIP ASSEMBLY FOR SKIN FORMULATION APPLICATOR

(75) Inventors: Richard A. Reishus, Renton, WA (US); Michael M. Itano, Seattle, WA (US); Kenneth A. Pilcher, Seattle, WA (US)

(73) Assignee: L'Oreal, Paris (FR)

( * ) Notice: Subject to any disclaimer, the term of this patent is extended or adjusted under 35 U.S.C. 154(b) by 1317 days.

(21) Appl. No.: 12/474,426

(22) Filed: May 29, 2009

(65) Prior Publication Data

US 2010/0300479 A1 Dec. 2, 2010

(51) Int. Cl.
*A61B 17/20* (2006.01)
*A45D 34/04* (2006.01)

(52) U.S. Cl.
CPC ..... *A45D 34/04* (2013.01); *A45D 2200/1018* (2013.01)

(58) Field of Classification Search
CPC ..... A45D 44/22; A61M 2039/2486; A61M 35/006
USPC ..... 604/20–22, 289, 290, 212–217
See application file for complete search history.

(56) References Cited

U.S. PATENT DOCUMENTS

| | | | | |
|---|---|---|---|---|
| 2,515,524 | A * | 7/1950 | Manzel | 601/119 |
| 3,749,438 | A * | 7/1973 | Loomis et al. | 294/81.53 |
| 4,225,254 | A * | 9/1980 | Holberg et al. | 401/119 |
| 5,322,518 | A * | 6/1994 | Schneider et al. | 604/247 |
| 6,601,591 | B1 * | 8/2003 | Carullo | A45D 40/00 132/320 |
| 7,055,807 | B2 * | 6/2006 | Pesta | 256/65.14 |
| 2004/0015139 | A1 * | 1/2004 | La Bianco | A61B 17/54 604/289 |
| 2008/0169312 | A1 * | 7/2008 | Kee | B05B 11/0048 222/205 |

* cited by examiner

*Primary Examiner* — Phillip Gray
(74) *Attorney, Agent, or Firm* — Clark A. Puntigam; Jensen & Puntigam, P.S.

(57) ABSTRACT

The tip assembly includes a base portion which is sufficiently rigid to be conveniently insertable onto and removable from a drive end of a motor for the applicator and a tip portion which is securely attached to the base portion either by casting or molding, and is sufficiently soft to provide comfortable contact with the skin, the tip portion having a concave front surface for receiving skin formulations which are applied to the skin, such as the facial skin, of a user during operation of the applicator.

25 Claims, 3 Drawing Sheets

APPLICATOR TIP ASSEMBLY FOR SKIN FORMULATION APPLICATOR

TECHNICAL FIELD

This invention relates generally to appliances for applying skin treatment formulations to the facial skin area of the body, and more particularly concerns a replaceable applicator tip assembly which fits on to a drive end of the appliance motor.

BACKGROUND OF THE INVENTION

In an electric power appliance capable of applying various skin formulations, including skin treatment formulations, to a selected skin area, such as the facial skin area of the body, the applicator tip which actually contacts the skin with the formulation has a relatively short life and hence requires replacement from time to time. Such an applicator tip must have a very soft forward portion to maintain comfortable contact with the user's skin when applying the formulation. A user who experiences discomfort will be unlikely to continue to use the appliance. The applicator tip must also be readily securable to and removable from a drive end of the appliance motor. The replaceable applicator tip must reliably couple with the motor drive end so as to withstand an oscillating action of the motor drive without resulting in substantial noise or lost motion. The applicator assembly shown and described herein accomplishes such desired objectives.

SUMMARY OF THE INVENTION

Accordingly, disclosed herein is an applicator tip assembly for use in an appliance for applying skin formulations, comprising: a base portion, sufficiently rigid to be insertable onto and removable from a drive end of a motor for the appliance and to move with the action of the motor drive end; and a tip portion which is sufficiently soft to provide comfortable contact with the facial skin of a user, wherein the base portion and the tip portion are securely mated so that they move together by action of the motor.

BEST MODE FOR CARRYING OUT THE INVENTION

Figure 1:
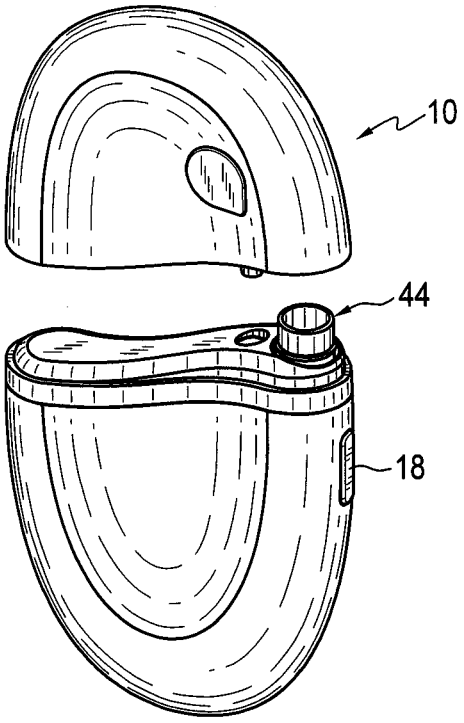
FIG. 1 is a schematic view of a skin formulation applicator.

FIG. 1 shows in general an applicator appliance 10 for applying skin formulations to various areas of the skin, in particular the facial area. The applicator 10 operates in a sonic frequency range of 50-200 Hz with a preferred range of 100-140 Hz. The applicator 10, referred to as a sonic skin applicator, includes a motor, a battery and a microprocessor controller, which are not shown specifically in FIG. 1. Reference is hereby made to co-pending patent application Ser. No. 12/135,887, the contents of which are hereby incorporated by reference. Applicator 10 is controlled by an on/off switch 18. Extending from the motor is a motor drive end member.

Removably mounted on the motor drive end member is an applicator tip assembly shown generally at 24 in FIG. 1, which comprises the subject matter of the present application. The applicator tip assembly has a limited life, and hence must be replaced at regular intervals during the lifetime of the applicator appliance. The drive end member of the motor oscillates in operation back and forth through a selected distance, typically in the range of 0.010-0.075 inches, with a preferred range of 0.020-0.035 inches. The applicator tip assembly 24, being firmly coupled to the drive end member, thus also oscillates similarly in operation. The mechanical properties of the tip applicator assembly, including the arrangement for removably attaching the applicator tip assembly to the drive end member are important to the overall function of the applicator appliance.

In general, the applicator tip assembly, shown herein in several embodiments, includes a tip portion which comes into direct contract with the skin of the user when applying the skin formulations, and must be very soft in order to preserve comfortable contact between the tip portion and the user. The applicator tip assembly also includes a base portion which must be rigid enough to attach firmly to the drive end member of the motor; once attached, the applicator tip assembly must remain sufficiently tightly coupled to the drive end member of the motor to withstand the oscillating action of the resonating motor, without lost motion or creating significant noise, resulting in quiet, reliable operation. Further, the applicator tip assembly as a unit must be easy to install onto and remove from the drive end member without the use of special tools or complicated maneuvering of the assembly. The applicator tip assembly is thus conveniently replaceable. Installation and removal of successive applicator tip assemblies must not damage the drive end element of the motor. In all the embodiments herein, the applicator tip assembly is designed to flex when installed or removed from the drive end member of the motor. This insures that the more rigid appliance motor is not damaged by repeated tip assembly installations and removals. Still further, the soft tip portion is arranged and secured to the base portion so that the two will not separate during operation of the appliance.

Figure 2:
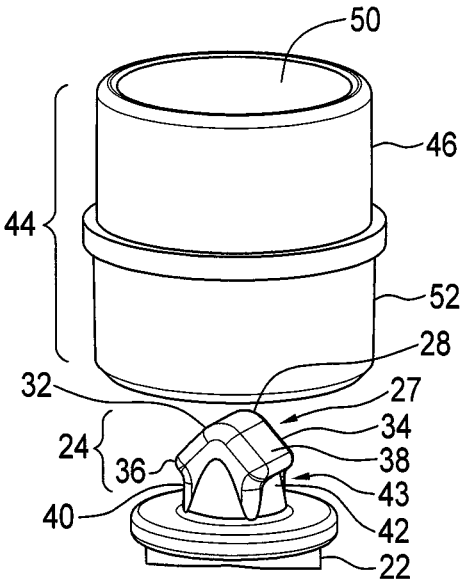
FIGS. 2, 3 and 4 are elevational, cross-sectional and bottom views, respectively, of one embodiment of a new applicator tip assembly for use on a skin formulation applicator.
Figure 3:
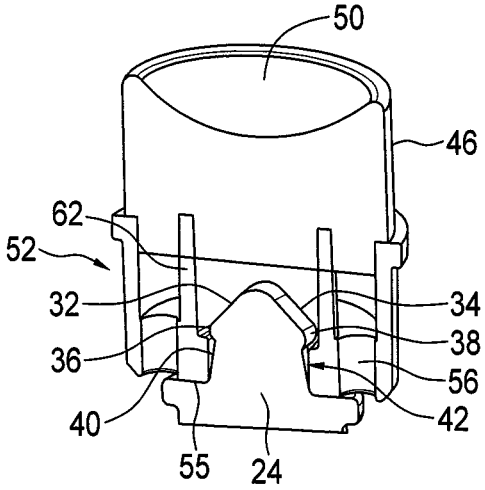
Figure 4:
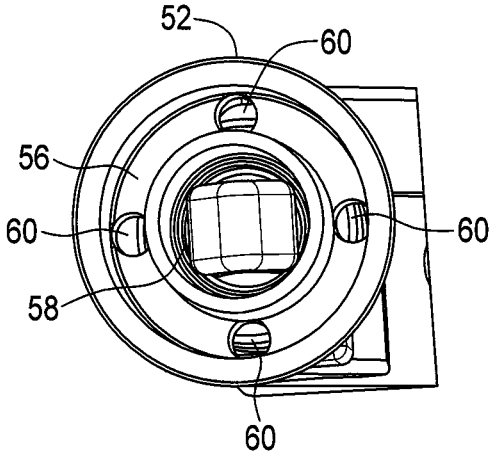
Figure 5:
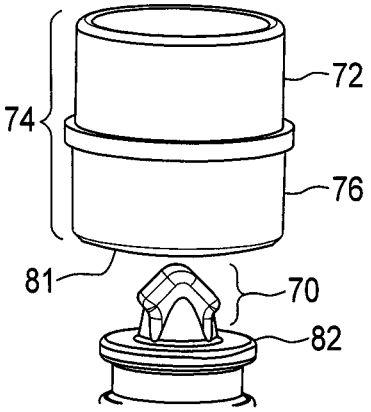
FIGS. 5, 6, 7 and 8 are elevational, perspective and two bottom views, respectively, of a second embodiment of the applicator tip assembly.
Figure 6:
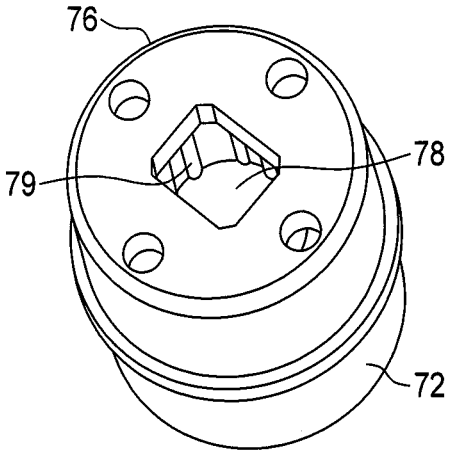
Figure 7:
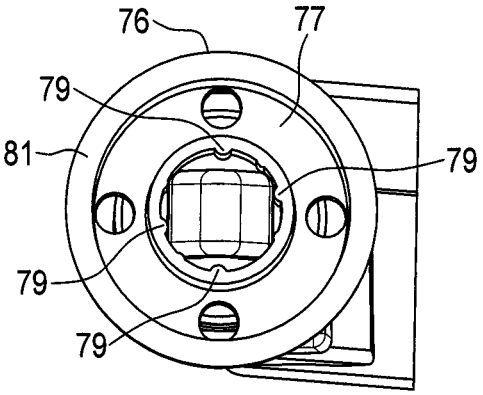
Figure 8:
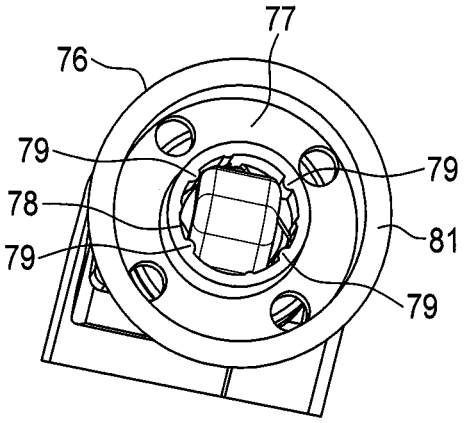
Figure 9:
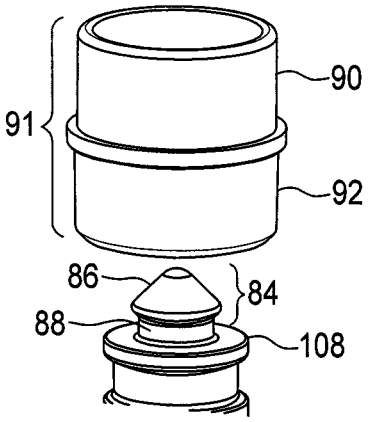
FIGS. 9, 10, 11, and 12 are elevational, perspective and cross-sectional views, respectively, of a third embodiment of the tip applicator assembly.
Figure 10:
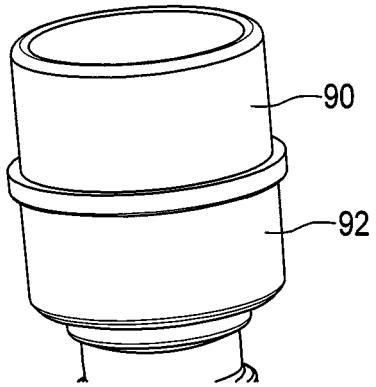

Referring now in the embodiment of FIGS. 2-4, drive end member 22 extending from the appliance motor has a square or rectangular cross-section and has the form of a double-tapered protrusion 24. While in general a square cross-section is preferred, it could also be rectangular. A first taper 27 is at the very forward end of protrusion 24. The taper 27 is rounded at its most forward point 28 and then tapers away at an angle between tapered surfaces 32 and 34 in the range of 70-110°, with a nominal angle of 90°. The tapered surfaces 32 and 34 are generally flat, although they do round inwardly at the lower ends thereof, defining rounded edges 36 and 38.

Tapering slightly outwardly from the inner ends of rounded edges 36 and 38 are tapered surfaces 40 and 42, defining a second taper 43. The combination of the two tapers 27 and 43 permits a secure attachment between the applicator tip assembly and the drive end member of the motor, while at the same time permitting the applicator tip assembly to be conveniently installed and then removed, as described more specifically below.

FIGS. 2, 3 and 4 show an applicator tip assembly 44 with a soft tip portion 46 which, in the embodiment shown, is circular in cross-section, approximately 0.40 inches in diameter, and is approximately 0.20 inches high at the peripheral edge thereof. These dimensions can vary, depending upon the particular application. The tip portion 46 includes a concave forward surface 50 which is designed to hold skin formulations. As indicated above, it is important that the tip portion be soft for comfort to the user and to improve the application and effective use of the formulation. Preferably, the tip portion material is a very low durometer silicone, elastomeric or similar rubber material, which can be either injection molded or cast onto the base portion of the tip assembly. In the embodiment shown, the material is a Shore scale OO Durometer 30 prosthetic grade silicone. This material has a very positive feel as well as good function. The good function is due to the fact that the flexibility of the material is similar to that of human skin and thus transmits motion and force efficiently.

The other portion of the tip assembly is a base portion shown generally at 52. In this embodiment, base portion 52 material is flexible, but not particularly soft. A high or low density polyethylene is suitable, as well as other comparable materials. The base portion 52 includes a lower element 56 having a central opening 58. The lower element also includes four equally spaced holes 60-60 outboard of opening 58, the purpose of which is to allow trapped air to escape during the casting process and allow the casting material to fill and adhere to the interior vertical walls of base portion 52.

The lower member 56 is flexible enough to permit the base portion 52 of the applicator tip assembly to be readily inserted onto protrusion 24. Opening 58 is somewhat smaller than the largest diameter dimension of rounded edges 36 and 38, so that when the applicator tip assembly is pushed past the first taper 27 to the point where the lower surface of the base portion abuts surface 55 of the drive end of the motor (FIG. 3), the lower element 56 of the base portion 52 rebounds such that the edge of opening 58 engages and is retained by an upper portion of the second taper 43. The material comprising the lower element 56 of base portion 52 is flexible enough that it deforms under pressure so as to permit the first taper 27 of protrusion 24 to move through the opening, permitting or allowing convenient installation and removal of the applicator tip assembly. When the lower element 56 rebounds to its original configuration following proper installation of the assembly, the applicator tip assembly is firmly latched onto the drive end member of the motor.

Extending upwardly from the upper surface of the lower element 56, outboard of opening 58, is a ring or cylinder 62, to which the soft tip portion 46 is either molded or cast, which results in a secure connection between the two portions of the assembly, i.e. so that the tip portion and the base assembly are securely joined and hence do not separate during normal oscillating action of the drive end member of the motor.

A second embodiment, shown in FIGS. 5-8, uses a similarly configured protrusion at the end of the drive end member to that of the embodiment of FIGS. 2-4. A square or a rectangular double-tapered protrusion is shown at 70, identical to that of FIG. 2. In the second embodiment, tip portion 72 of the applicator tip assembly 74 is basically the same as tip portion 46 in the embodiment of FIGS. 2-4. Base portion 76 comprises a less flexible material than the base portion of the embodiment of FIGS. 2-4. ABS or similar materials are used in this embodiment. Lower element 77 of base portion 76 includes an opening 78 into which protrusion 70 freely fits. A square opening is generally preferred, although a rectangular shape can be used as well. In this embodiment, a number of small ribs 79 are molded onto an interior ring or cylindrical member 80 which extends upwardly from the lower element 76. The upper part of ring member 80 receives the tip portion, which is molded or cast thereon.

In this embodiment, base portion 76 is inserted onto protrusion 70 until lower ring surface 81 of the base portion abuts surface 82 of the motor drive end member. In this position, the side edges of the first tapered portion are within the ribbed ring member 80 then rotated through an angle in the range of 30-60°, with a preferred angle of 45°, which latches the applicator tip assembly onto the protrusion by an interference fit between ribs 79 and the edges of the first taper of protrusion 70. When the applicator tip assembly is to be removed for replacement, the tip assembly is rotated in the opposite direction the same amount and then pulled away from the protrusion.

Another embodiment is shown in FIGS. 9-12. In this embodiment, protrusion 84 at the drive end member has a different configuration. A forward section/taper 86 of the protrusion is conical, while a rear section 88 is generally cylindrical in cross-section. In this arrangement, tip portion 90 of the applicator assembly 91 has the same characteristics set forth for the above embodiments. Base portion 92 comprises a relatively rigid material such as ABS or similar material. In this embodiment, base portion 92 includes an outer cylindrical wall 93 and an inner cylindrical ring 94. Extending from inner ring 94 to outer cylindrical wall 93 are three equally spaced web elements 98-98, located near the upper edge of the outer wall 93. This provides structural stability between inner ring 94 and outer wall 93. Extending downwardly from inner ring member 94, between the web elements 98, are three spaced vertical legs 100-100, typically equally spaced. The lower edges of the vertical legs are free to move outwardly under pressure, as the lower edges are not secured to wall 93. They are resilient, however, so that when outward pressure on the vertical legs is released they snap back into their initial, substantially vertical position. While three web elements and three vertical legs are disclosed, it should be understood that other numbers of those elements could be used, for example 2 or 4 elements.

Figure 11:
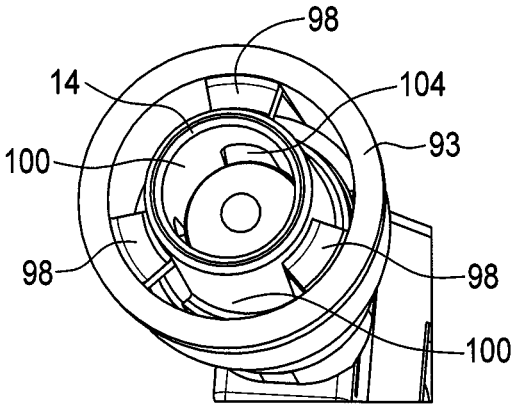
Figure 12:
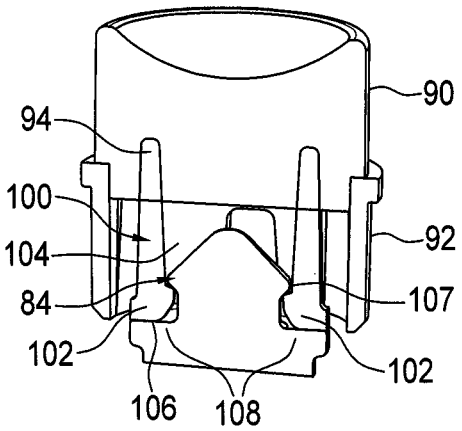

The lower edge portions 102 of the three vertical legs are rounded and extend slightly into the cylindrical opening 104 defined partially by the vertical legs 100, as well as slightly outboard of the remainder of the vertical legs, as shown most clearly in FIG. 11. The vertical legs 100 are configured relative to protrusion 84 such that the base portion of the applicator tip assembly can be snapped onto the protrusion, with a portion of the lower edges 102 of the vertical legs abutting lower edge 107 of taper 86 of the protrusion as well as horizontal surface 108 of the drive end member, tending to hold the applicator tip assembly firmly into place on the protrusion.

The tip portion 90 is molded or cast onto the upper part of inner ring 94 of base portion 92, securing the two parts together. When the applicator tip assembly is to be removed, longitudinal force is exerted outwardly on the applicator tip assembly, which results in the vertical legs 100 being temporarily spread outwardly, permitting the applicator tip assembly to be removed from protrusion 84.

Hence, a replaceable applicator tip assembly for use with an applicator for skin formulations has been disclosed. It includes a tip portion which is securely molded or cast onto a base portion, with the tip portion being quite soft so as to provide comfort and efficacy when in contact with the user's skin. The base portion of the applicator tip assembly is relatively rigid, permitting a secure, dynamic connection with the drive end element from the applicator motor, while at the same time permitting convenient installation and removal of the tip assembly onto the protrusion. As indicated above the tip applicator assembly is conveniently replaceable, since the life of the applicator is considerably longer than the life of the tip assembly. The tip assembly is easy to install and remove, without the need for tools, yet is secure when installed, without loss of motion and providing quiet operation. Several embodiments have been disclosed for accomplishing this combination of desired functions.

Although a preferred embodiment has been disclosed for purposes of illustration, it should be understood that various changes and modifications and substitutions could be made in the preferred embodiment without departing from the spirit of the invention as defined by the claims which follow:

What is claimed is:

1. An applicator tip assembly for use in an appliance for applying skin formulations, comprising:

a base portion, sufficiently rigid to be insertable onto and removable from a drive end of a motor for the appliance and further structurally configured and arranged to mate with a correspondingly configured drive end of the motor so that it moves with a linear oscillating action with the motor drive end toward and away from the skin of a user; and a tip portion which is sufficiently soft to provide comfortable contact with the facial skin of a user, wherein the tip portion includes only one concave forward surface without an opening therethrough, circular in cross-section, configured to receive skin formulations, and wherein the base portion and the tip portion are so securely mated that they move together by the oscillating, linear action of the motor.

2. The applicator tip assembly of claim 1, wherein the tip potion is soft silicone or rubber, approximately Shore scale OO Durometer 30.

3. The applicator tip assembly of claim 1, wherein the action of the motor end drive is oscillating in a linear direction.

4. The applicator tip assembly of claim 3, wherein the oscillation is within the frequency range of 50-200 Hz.

5. The applicator tip assembly of claim 3, wherein the oscillation is within the range of 100-140 Hz.

6. The applicator tip assembly of claim 1, wherein the tip portion is molded or cast onto a tip attachment element or elements which extend upwardly from the base portion.

7. The applicator tip assembly of claim 1, wherein the drive end element includes a protrusion portion at a forward end thereof.

8. The applicator tip assembly of claim 7, wherein the protrusion is square or rectangular in cross-section and has a forward larger portion and a rear smaller portion.

9. The applicator tip assembly of claim 8, wherein the larger portion and the smaller portions both are tapered.

10. The applicator tip assembly of claim 7, wherein the protrusion has a conical forward section and a smaller rear section.

11. The applicator tip assembly of claim 7, wherein the base portion includes a lower element portion, having an opening which is configured and arranged to be smaller than the protrusion but sufficiently flexible to permit installation thereof onto the protrusion, wherein an inner edge of the opening abuts a rear taper portion of the protrusion, securely holding the applicator tip assembly onto the protrusion.

12. The applicator tip assembly of claim 6, wherein the attachment element is a continuous ring.

13. The applicator tip assembly of claim 7, wherein the base portion includes a lower element with a central opening through which the protrusion can move, and an inner surface having rib portions which are arranged and configured to latch and securely hold the tip assembly onto the protrusion following insertion of the tip assembly and rotation thereof a partial turn.

14. The applicator tip assembly of claim 7, wherein the base portion includes an outer wall and an inner ring secured to the outer wall by spaced web members, the inner ring including flexible legs/elements between the web members which extend downwardly and are arranged and configured to permit a first taper portion of the protrusion to move therethrough by spreading the leg elements outwardly, wherein the leg elements spring back against the protrusion, holding the tip assembly securely onto the protrusion.

15. The applicator tip assembly of claim 14, wherein the leg elements are equally spaced and sufficiently flexible to permit the tip assembly to be removed from and installed onto the protrusion, while holding the tip assembly against the protrusion in operation to prevent lost motion.

16. In combination, an applicator tip assembly and a motor in an appliance for applying skin formulations, comprising:

an appliance motor having a drive end;

an applicator tip assembly having a base portion and a tip portion, wherein the base portion is sufficiently rigid to be insertable onto and removable from the drive end of the motor and further structurally configured and arranged to mate with the drive end of the motor so that it moves with a linear oscillating action with the action of the motor drive end toward and away from the skin of a user; and wherein the tip portion is sufficiently soft to provide comfortable contact with the facial skin of a user, wherein the tip portion includes only one concave forward surface without an opening therethrough, circular in cross-section, configured to receive skin formations, and wherein the base portion and the tip portion are so securely mated that they move together by the oscillating, linear action of the motor.

17. The combination of claim 16, wherein the oscillation is within the frequency range of 50-200 Hz.

18. The combination of claim 16, wherein the drive end of the motor includes a protrusion portion at a forward end thereof.

19. The combination of claim 18, wherein the protrusion is square or rectangular in cross-section and has a forward larger portion and a rear smaller portion.

20. The combination of claim 19, wherein the larger portion and the smaller portions both are tapered.

21. The combination of claim 18, wherein the protrusion has a conical forward section and a smaller rear section.

22. The combination of claim 18, wherein the base portion includes a lower element portion, having an opening which is configured and arranged to be smaller than the protrusion but sufficiently flexible to permit installation thereof onto the protrusion, wherein an inner edge of the opening abuts a rear portion of the protrusion, securely holding the applicator tip assembly onto the protrusion, without loss of motion during the linear oscillating action of the motor.

23. The combination of claim 16, wherein the base portion includes a lower element with a central opening through which the protrusion can move, and an inner surface having rib portions which are arranged and configured to latch and securely hold the tip assembly onto the protrusion following insertion of the tip assembly and rotation thereof a partial turn.

24. The combination of claim 18, wherein the base portion includes an outer wall and an inner ring secured to the outer wall by spaced web members, the inner ring including flexible legs/elements between the web members which extend downwardly and are arranged and configured to permit a first taper portion of the protrusion to move therethrough by spreading the leg elements outwardly, wherein the leg elements spring back against the protrusion, holding the tip assembly securely onto the protrusion.

25. The combination of claim 24, wherein the leg elements are equally spaced and sufficiently flexible to permit the tip assembly to be removed from and installed onto the protrusion, while holding the tip assembly against the protrusion in operation to prevent lost motion.

* * * * *